United States Patent [19]

Naruse

[11] Patent Number: 4,832,715

[45] Date of Patent: May 23, 1989

[54] FINE PARTICLE COLLECTOR ARRANGEMENT FOR VACUUM PUMPS

[75] Inventor: Humio Naruse, Yokohama, Japan

[73] Assignee: Nihon Shinku Gijutsu Kabushiki Kaisha, Chigasaki, Japan

[21] Appl. No.: 149,014

[22] Filed: Jan. 27, 1988

[30] Foreign Application Priority Data

Feb. 2, 1987 [JP] Japan ..... 62-20382

[51] Int. Cl.[4] ..... B01D 5/00

[52] U.S. Cl. ..... 55/193; 55/80; 55/269

[58] Field of Search ..... 55/80, 81, 84, 209, 55/269, 94, 192, 193

[56] References Cited

U.S. PATENT DOCUMENTS 2,833,370 5/1958 Sherwood ..... 55/209
3,411,270 11/1968 Cornelius et al. ..... 55/193 X
4,391,617 7/1983 Way ..... 55/209
4,497,641 2/1985 Brown et al. ..... 55/94
4,515,629 5/1985 Dizek et al. ..... 55/193 X
4,675,031 6/1987 Sinnar ..... 55/81

*Primary Examiner*—Charles Hart
*Attorney, Agent, or Firm*—Brady, O'Boyle & Gates

[57] ABSTRACT

The present invention relates to a fine particle collector arrangement for vacuum pumps, in which high temperature walls and low temperature walls are alternately provided in the collecting chamber to form gas flow passage which is extended from the inlet conduit connected with the vacuum processing chamber to the outlet conduit connected with the vacuum pump, and the gas flow passage has larger cross section than that of the inlet conduit. Fine particles in gas flowing from the inlet conduit are deposited on the each low temperature wall member to be efficiently collected by the thermal creep velocity caused by the thermophoretic force.

7 Claims, 2 Drawing Sheets

FINE PARTICLE COLLECTOR ARRANGEMENT FOR VACUUM PUMPS

FIELD OF THE INVENTION

The present invention relates to a fine particle collector arrangement for vacuum pumps, which is installed between a vacuum processing chamber and the vacuum pump for collecting fine particles, such as dusts or the like existing in the vacuum processing chamber before they are carried to the vacuum pumps.

BACKGROUND OF THE INVENTION

Heretofore, when the vacuum chamber of a film forming apparatus in which dust in large quantity may be generated is, for example, evacuated by a vacuum pump, it is known that there is provided a mesh member for adhering or collecting the dusts in a gas to be evacuated, the mesh member being interposed in an evacuating passage to protect the vacuum pump from the dusts. It is also known that a drum rotating in oil is provided in the evacuating passage to adhere the dusts in the gas to be evacuated to the surface of the drum or small articles which are contained in the drum.

In an ultrafine particle producing apparatus, produced ultrafine particles are deposited in a collecting chamber to be collected.

When the gas to be evacuated is passed through the mesh member or the drum rotating in oil, Reynolds number is small since the evacuated gas is lower pressure, and the flow is laminar. Therefore, the above-mentioned adhesion of fine or ultrafine particles mainly depends on the diffusion effect by the Brownian motion of these particles.

In this case, in order to sufficiently remove the dusts, it is necessary to narrow the evacuating passage through which the evacuated gas is flowed, and therefore a large difference in pressure is required to pass the evacuated gas. This pressure difference has disadvantage that it causes the pressure in the vacuum chamber of the film forming apparatus to be raisen. Thus, the evacuating passage should be formed relatively large so as not to considerably increase the pressure difference, and this makes it difficult to sufficiently remove the dusts from the evacuated gas. Since there is the pressure difference between the vacuum chamber and the evacuating system, the vacuum pump which is to be used for evacuating the vacuum chamber is limited to a low (rough) vacuum type, and there is a disadvantage that a high vacuum condition can not be obtained in the vacuum chamber. Further, with using of oil to remove the dusts, oil component may flow into the vacuum chamber, which unpreferably gives adverse influence to the film forming apparatus.

With the ultrafine particle producing apparatus, the produced ultrafine particles are intaken together with the evacuated gas by the vacuum pump to cause defects to deteriorate the efficiency for collecting these particles.

It is, therefore, an object of the present invention to solve the drawbacks of the above-mentioned conventional apparatuses and to provide a fine particle collector arrangement for vacuum pumps which can effectively collect fine particles such as dusts or the like in low pressure gas without raising the pressure difference between a vacuum chamber and an evacuating system.

Another object of the invention is to provide a fine particle collector arrangement for vacuum pumps which makes it possible to use a vacuum pump obtaining relatively high vacuum with ready manufacture and provide easy maintenance.

A further object of the invention is to provide a fine particle collector arrangement for vacuum pumps which may be utilized for collecting ultrafine particles produced in an ultrafine particle producing apparatus.

SUMMARY OF THE INVENTION

According to the present invention, there is provided a fine particle collector arrangement for vacuum pumps comprising a fine particle collecting chamber having an inlet conduit connected to a vacuum processing chamber in which a processing is performed and an outlet conduit connected to at least one vacuum pump, and at least one high temperature wall member and at least one low temperature wall member which are disposed oppositely to each other in said fine particle collecting chamber to define a flow passage having a temperature gradient from said high temperature wall member to said low temperature wall member. It is prefer that said flow passage has larger cross section than that of said inlet conduit.

Preferably, said fine particle collecting chamber may be provided with a plurality of platelike high temperature wall members and a plurality of platelike low temperature wall members which are alternately interposed to form said passage in a zigzag shape.

Said fine particle collecting chamber may comprise chamber body on the inner surface of which said platelike low temperature wall members are provided at intervals, and a cover on the inner surface of which said platelike high temperature wall members are provided at intervals.

On the outer side of the collecting chamber body is provided means for cooling said platelike low temperature wall members.

On the outer side of the cover is provided means for heating said platelike high temperature wall members.

The inlet conduit may be connected, for example, to the vacuum chamber of the film forming apparatus, and the outlet conduit may be connected to the vacuum pump for evacuating in low or middle vacuum. When the vacuum pump is operated, gas prevailed in the vacuum chamber is intaken through the passage in the collecting chamber to the vacuum pump, and fine particles such as dusts in the gas intaken by the vacuum pump move at a certain velocity by the thermophoretic force from the high temperature side to the low temperature side in the passage of the collecting chamber to be adhered to the low temperature wall members. Since the fine particles have the same moving velocity at lower temperature gradient, the smaller the pressure becomes, the fine particles in the gas can be sufficiently attracted to the low temperature wall members even when the space between the respective low temperature wall member and the respective high temperature wall member is increased to reduce the temperature gradient, i.e., when the cross section of the flow passage is increased.

Further, when the flow passage in the collecting chamber is formed in a zigzag shape, a long passage for effectively removing the fine particles from the gas can be easily obtained in a small-sized collecting chamber. Since the cross section of the collecting passage is larger than that of the inlet conduit the pressure difference required to collect fine particle may be small, so that a vacuum pump of relatively high vacuum type there may be used, thereby rapidly reducing the pressure in the vacuum chamber.

The above and other objects, features, and advantages of the invention will become apparent upon consideration of the following detailed description taken in connection with the accompanying drawings:

DETAILED DESCRIPTION

Figure 1:
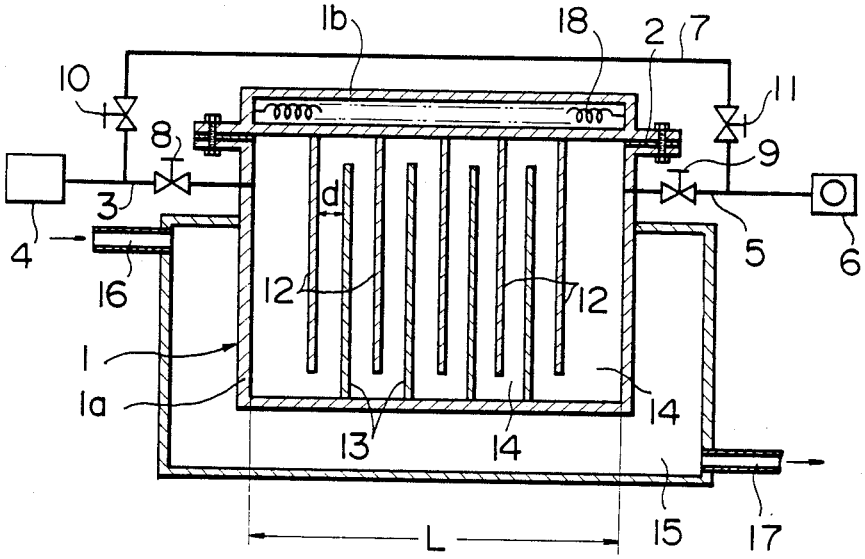
FIG. 1 is a longitudinal sectional view showing the essential portion of a fine particle collector arrangement for vacuum pumps according to the present invention.

Reference is now made to FIG. 1 of the drawings wherein an embodiment of the present invention is shown.

In FIG. 1, reference numeral 1 designates a fine particle collecting chamber which comprises a chamber body 1*a* and a cover 1*b* tightly fixed on the flange thereof via a sealing member 2. The chamber body 1*a* is provided with an inlet conduit 3 at one side wall thereof which is connected to a vacuum chamber 4 for a film forming apparatus (not shown) and an outlet conduit 5 at the other side wall which is connected to a vacuum pump 6 such as a mechanical booster pump. The inlet conduit 3 and the outlet conduit 5 are interconnected by a bypass conduit 7. The inlet conduits 3 is provided with a valve 8, the outlet conduit 5 with a valve 9, and the bypass conduit 7 with two valves 10 and 11.

In the chamber 1 there are disposed five platelike high temperature wall members 12 and five platelike low temperature wall members 13 which are alternately interposed to form a flow passage 14 in a zigzag shape. This zigzag passage 14 is so arranged that it has a larger cross section than that of the inlet conduit 3. Each of the high temperature wall members 12 is downwards fixed on the inner surface of the cover 1*b*. Each of the low temperature wall members 13 is upwards fixed on the inner surface of the chamber body 1*a*.

The chamber body 1*a* is provided with a coolant channel 15 around the outer surface thereof for cooling the low temperature wall members 13. The coolant channel 15 comprises a coolant feeding-in conduit 16 and a coolant feeding-out conduit 17. The cover 1*b* is provided with a heater 18 therein for heating the high temperature wall members 12. This heater may be energized by a suitable power supply (not show). It is appreciated that such cooling means and heating means may be arbitrarily provided, and if desired, the heater may be directly buried in the respective high temperature wall members 12.

The operation of the embodiment, as shown, will be described. It is assumed that the valves 8 and 9 in the inlet and outlet conduits 3 and 5 are opened and the valves 10 and 11 in the bypass conduit 7 are closed. When the vacuum pump 6 is operated, gas containing fine particles flows from the vacuum chamber 4 through the inlet conduit 3 and the zigzag passage 14 defined by the high and low temperature wall members 12 and 13 to the outlet conduit 5 to be intaken into the vacuum pump 6. Since the high temperature wall members 12, for example, at 120° C. and the low temperature wall members 13 at 20° C. are alternately provided, a temperature gradient occurs perpendicularly across the passage 14 in the gas flowing therethrough, and the fine particles in the gas move from high temperature side to low temperature side in the zigzag passage 14 at a certain velocity by the thermophoretic force and is to be deposited on the low temperature wall members 13. In this case, the lower the pressure in the passage 14 becomes, the moving velocities of the fine particles become the same at lower temperature gradient. Therefore, the space between each high temperature wall member 12 and the adjacent low temperature wall member 13 can be increased to a certain extent so as to collect the fine particles from the gas flowing at low pressure, and consequently it becomes possible to almost arbitrarily increase the cross section of the passage 14 as compared with that of the inlet conduit 3, considering that the chamber 1 may take a very large lateral width. Thus, the pressure difference required for feeding to the passage 14 can be substantially reduced, and not only low vacuum pump but also a vacuum pump having relatively high vacuum performance can be available. Further, since the performance of the used vacuum pump can be sufficiently utilized, the pressure of the vacuum chamber 4 can be evacuated to relatively higher vacuum.

In case the vacuum pump 6 is frequently operated and stopped, the valves 8 and 9 in the inlet and outlet conduits 3 and 5 are closed, the valves 10 and 11 in the bypass conduit 7 are so opened to bypass the gas through the bypass conduit 7, and then it can be avoided that the fine particles collected in the chamber 1 are whirled up by the pressure variation occurred due to the energizing and deenergizing of the vacuum pump 2 and are fed out from the chamber 1.

The fine particles deposited on the low temperature wall members 13 and the other portion in the chamber 1 can be easily removed by removing the upper cover lb.

It should be understood that the size of the collecting chamber 1 may be selected depending upon the gas flow rate to be passed. For example, in case of a plasma CVD apparatus in which $SiH_4$ gas is fed at 5SLM into the collecting chamber 1 under pressures 1 to 5 Torr, the collecting chamber 1 is formed at approx. 50 cm length L, 55 cm height and 50 cm lateral width, five high temperature wall members 12 of plate shape having each of height 50 cm and lateral width 49.5 cm are provided and heated to approx. 120° C., four low temperature wall members 13 of plate shape each having height 50 cm and lateral width 50 cm are provided and cooled to 20° C., and the space d between the adjacent high and low temperature wall members is set to 4 cm. In this case, when the pressure in the collecting chamber 1 is 5 Torr, the pressure difference between the inlet conduit 3 and the outlet conduit 5 becomes $10^{-2}$ Torr or lower.

In case the present invention is to be applied for an ultrafine particle producing apparatus, it will be understood that the inlet conduit is connected to a vacuum chamber in which ultrafine particles are produced.

Figure 2:
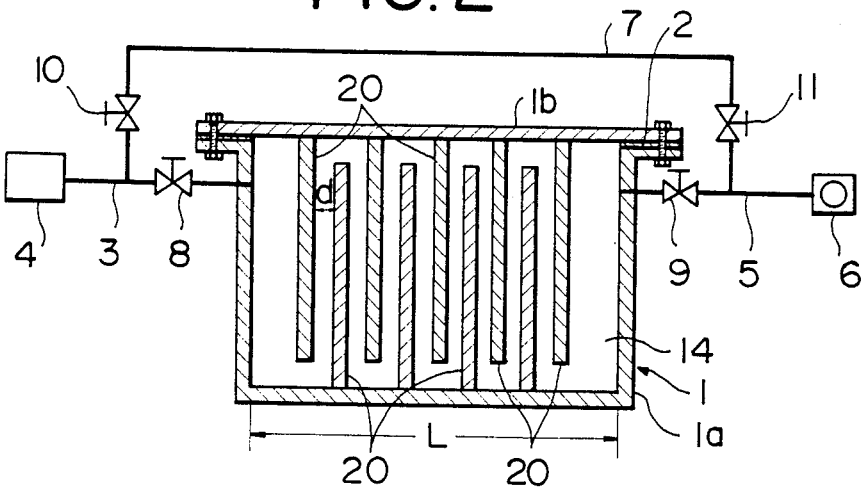
FIG. 2 is a longitudinal sectional view showing another embodiment according to the present invention.
Figure 3:
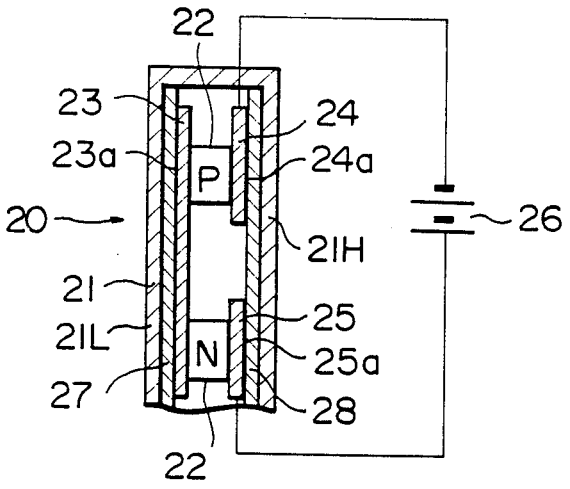
FIG. 3 is an enlarged sectional view showing the essential portion of the arrangement of FIG. 2.

FIGS. 2 and 3 show a modified embodiment of the present invention, in which the components are the same as those in the first embodiment of FIG. 1 except that the construction of a high and low temperature wall members is different from that of the first embodiment. Thus, the reference numerals are used to designate the components corresponding to those in the first embodiment.

In this embodiment, there are used nine platelike wall members 20 each of which has a high temperature surface at one side and a low temperature surface at the other side, and is disposed so that the high temperature surface of one wall member is opposite to the low temperature surface of the adjacent wall member with a space d. As shown in FIG. 3, each wall member 20 comprises an outer hollow wall 21 and two electronic cooling elements 22 utilizing Peltier effect which are contained in the outer hollow wall 21, and one is P-type semiconductor and the other N-type semiconductor. One ends of both semiconductors 22 are connected to each other by means of a common terminal conductor strip 23, and the other ends thereof are connected to separated terminal conductor strips 24 and 25, respectively. The separated terminal conductor stripes 24 and 25 are connected to a direct current source 26. Further, between the outer hollow wall 21 and each of the common terminal conductor strip 23 and the separated terminal conductor strips 24 and 25, there are respectively interposed insulator members 27 and 28.

When the semiconductor elements 22 are supplied with DC current from the source 26, the surfaces 24*a* and 25*a* of the terminal conductor strips 24 and 25 are heated and the surface 23*a* of the terminal conductor strip 23 is cooled. Therefore, the terminal conductor strips 24 and 25 behave as a heating element and the common terminal conductor strip 23 behaves as a heat absorption element, and thus one side 21H of the outer hollow wall 21 constitutes high temperature wall surface and the other side 21L thereof low temperature wall surface. In this connection, it will be appreciated that the both side walls 21H and 21L of the outer hollow wall 21 should be preferably thermally insulated in order to avoid any reduction of the temperature difference therebetween.

Figure 4:
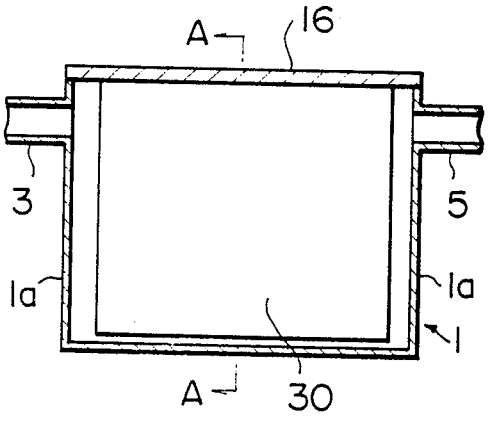
FIG. 4 is a longitudinal sectional view showing a further embodiment according to the present invention.
Figure 5:
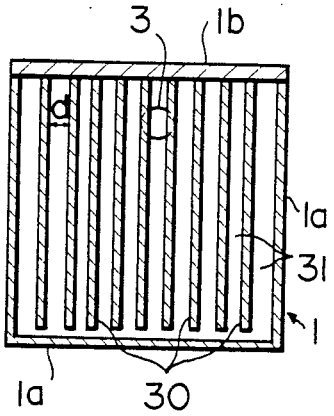
FIG. 5 is a cross sectional view taken along the line A—A in FIG. 4.

FIGS. 4 and 5 show a modification of the second embodiment of FIGS. 2 and 3, in which the components are the same as those in the second embodiment except that the arrangement of the high and low temperature wall members is different from that of the second embodiment. Thus, the reference numerals are used to designate the components corresponding to those in the second embodiment.

That is, each of the wall members 30 has substantially the same construction as that of the wall member 20 shown in FIG. 3, but all of them are disposed on the cover 1*b* of the collecting chamber 1 so that a plurality of parallel flow channels 31 are formed. In this case, it will be understood that the construction of the device can be more simplified and also the cleaning thereof can be more easily performed.

Further, the first embodiment of the present invention, shown in FIG. 1, may be modified as shown in FIGS. 4 and 5.

In this case, each of the high temperature wall members is fixed on the inner surface of the cover 1*b* which is provided with the heater, and each of the low temperature wall members is fixed on the inner surface of the chamber body which is provided with a coolant channel, and a plurality of platelike high temperature wall members and a plurality of platelike low temperature wall members are alternately interposed to form said parallel flow channels.

According to the present invention as described above, high temperature walls and low temperature walls are alternately provided in the collecting chamber to form gas flow passage(s) which is extended from the inlet conduit connected with the vacuum processing chamber to the outlet conduit connected with the vacuum pump, and the gas flow passage(s) has larger cross section than that of the inlet conduit. Therefore, fine particles in gas flowing from the inlet conduit may be deposited on the each low temperature wall member to be efficiently collected. Since no pressure difference is generated to collect the fine particles, the performance of the vacuum pump can not be deteriorated, thereby highly evacuating the vacuum processing chamber. Further, it is possible to collect the fine particles in a dry system without using oil, and thus the vacuum processing chamber is not contaminated. The present invention has also advantage that it is possible to simplify the manufacture and to perform readily the maintenance.

What is claimed is:

1. A fine particle collector arrangement for vacuum pumps comprising, a vacuum processing chamber in which a processing is performed, at least one vacuum pump, a fine particle collecting chamber including a chamber body having an inner surface and a removable cover for the chamber body having an inner surface, means sealing said removable cover to said chamber body, said chamber body having an inlet conduit connected to said vacuum processing chamber and an outlet conduit connected to said at least one vacuum pump, at least one high temperature wall member depending from the inner surface of said cover, and at least one low temperature wall member connected on said inner surface of said chamber body, said high and low temperature wall members disposed oppositely to and in spaced offset relation to each other in said fine particle collecting chamber to define a flow passage, cooling means connected to said chamber body to cool said low temperature wall member, and means on said removable cover for heating said high temperature wall member thereon to produce a temperature gradient from said high temperature wall member to said low temperature wall member in the range of 100° C.

2. A fine particle collector arrangement as claimed in claim 1, wherein said flow passage has a larger cross section than that of said inlet conduit.

3. A fine particle collector arrangement as claimed in claim 1, wherein said flow passage is formed in a zigzag shape.

4. A fine particle collector arrangement as claimed in claim 1, wherein said flow passage is formed in parallel channels.

5. A fine particle collector arrangement as claimed in claim 1, wherein said each high temperature wall member is internally heated.

6. A fine particle collector arrangement for vacuum pumps comprising, a vacuum processing chamber in which a processing is performed, at least one vacuum pump, a fine particle collecting chamber including a chamber body and a removable for said chamber body, means sealing said removable cover to said chamber body, said chamber body having an inlet conduit connected to said vacuum processing chamber and an outlet conduit connected to said at least one vacuum pump; at least one high temperature wall member provided on the inner surface of said cover and at least one low temperature wall member provided on the inner surface of said chamber body, said high and low temperature wall members being disposed oppositely to and in spaced offset alternately interposed relation to each other in said fine particle collecting chamber to define a zigzag flow passage or parallel flow channels having a larger cross section than that of said inlet conduit; cooling means disposed on the outer side of said collecting chamber body for cooling said each low temperature wall member; and heating means disposed on the outer side of said cover for heating aid each high temperature wall member, whereby a temperature gradient in the range of 100° C. is formed from each high temperature wall member to each low temperature wall member and the fine particles in flowing gas are moved from the high temperature side to the low temperature side at a velocity by the thermophoretic force and are deposited on said each low temperature wall member.

7. A fine particle collector arrangement as claimed in claim 6, wherein each of said high and low temperature wall members is platelike.

* * * * *